United States Patent [19]

Arlett

[11] 4,228,707

[45] Oct. 21, 1980

[54] CUTTER FOR CUTTING MATCH SPLINTS

[75] Inventor: John Arlett, Camberley, England

[73] Assignee: Bryant & May Limited, London, England

[21] Appl. No.: 11,545

[22] Filed: Feb. 12, 1979

[51] Int. Cl.[3] ..... B27L 9/00; B26D 5/10

[52] U.S. Cl. ..... 83/387; 83/375; 83/453; 83/597; 30/134; 83/926 J

[58] Field of Search ..... 83/375, 385, 386, 387, 83/926 J, 453, 597; 30/134

[56] References Cited

U.S. PATENT DOCUMENTS

| | | | |
|---|---|---|---|
| 679,167 | 7/1901 | Garding | 83/387 |
| 2,320,460 | 6/1943 | Müller | 30/134 |
| 3,323,208 | 6/1967 | Hurley | 30/134 |
| 3,709,079 | 1/1973 | Würker | 83/375 |

FOREIGN PATENT DOCUMENTS

| | | | |
|---|---|---|---|
| 2637012 | 2/1978 | Fed. Rep. of Germany | 83/926 J |

*Primary Examiner*—Donald R. Schran

*Attorney, Agent, or Firm*—Leydig, Voit, Osann, Mayer & Holt

[57] ABSTRACT

The invention relates to cutters, and provides a cutter comprising a base and a cutting-blade carrying arm. The base and the arm may be parts of a one-piece plastic molding which incorporates a connection between the base and the arm, which connection permits movement of the arm relative to the base during the cutting action. The arm may carry at least one flexible member which engages the material to be cut prior to engagement of the material by the cutting blade, whereby the material is restrained from movement during the cutting action.

3 Claims, 4 Drawing Figures

CUTTER FOR CUTTING MATCH SPLINTS

This invention relates to cutters.

The novel features of the present invention will be readily apparent from the following description of one construction of cutter in accordance with the invention, which will now be described by way of example only with reference to the accompanying drawings, in which.

This construction is designed for cutting match splints. Constructonal kits are sold which comprise match splints, for example a wooden splint of the kind used for safety matches, but which does not have a coated tip. When using such splints in this way, it may be desired to cut some of them to a predetermined length, and this is the function of the cutter to be described. However, features of this construction may be used in cutters intended for other purposes.

This construction is, with the exception of the cutting blade, a one-piece plastic moulding, for example moulded from polypropylene. The cutter has a base 10 joined by an integral hinge 11 to a cutter arm 12. The base carries a cradle 13 which has a V-section seat 13*a* with an included angle of approximately 90°, for receiving a match splint of square cross section. The seat 13*a* is provided with an appropriate scale 13*b* measured from its transverse centre line, so that a predetermined length of splint can be cut.

Figure 2:
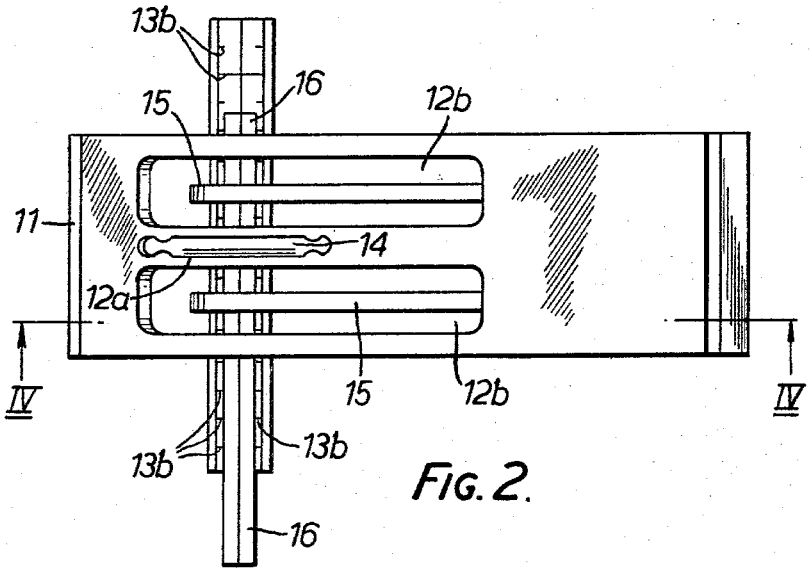
FIG. 2 is a plan view of the cutter.

The cutter arm 12 carries a cutter blade 14 which is inserted in a slot 12*a* (FIG. 2) in the arm 12 and is secured in position, for example by ultrasonic welding of the plastic adjacent the blade 14.

The cutter arm 12 has elongated slots 12*b*, 12*b* on either side of the blade carrying portion and has two parallel elongated holding fingers 15, 15, the tips of which have faces 15*a*, 15*a* designed to engage a splint 16 on the cradle 13, as shown in the drawings. Prior to engagement with the splint 16, the faces 15*a*, 15*a* lie closer to the cradle 13 than does the cutting edge 14*a* of the cutter 14. Additionally, the cutting edge 14*a* is below the level of the adjacent parts of the cutter arm 12. In this way the cutting edge is shrouded to make it more difficult for the user to cut himself accidentally.

Figure 1:
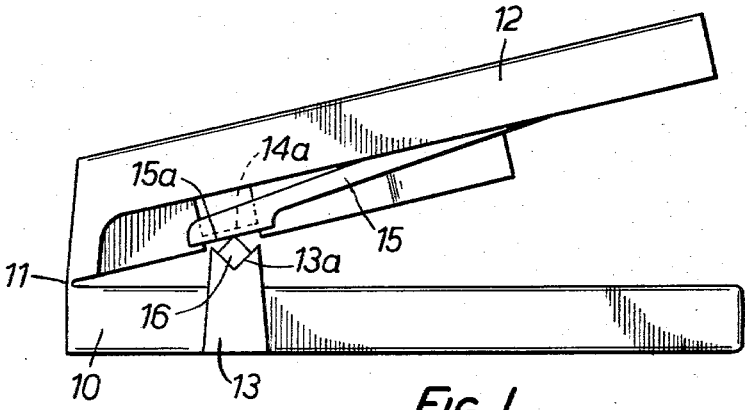
FIG. 1 is a side elevation of this construction of cutter.
Figure 3:
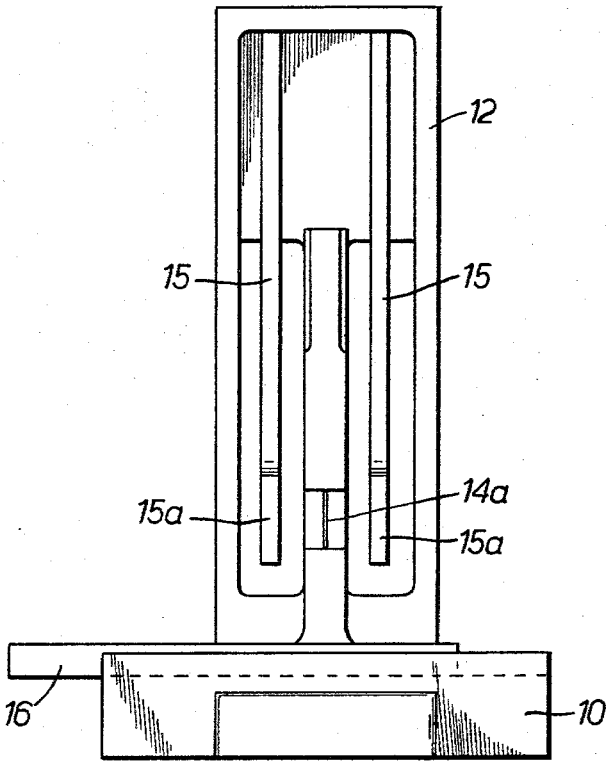
FIG. 3 is an end view showing the cutter arm in an upright position, whilst
Figure 4:
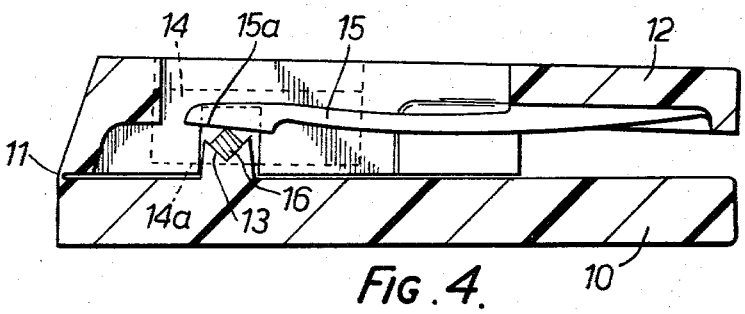
FIG. 4 is a sectional view along line IV—IV in FIG. 2.

In use, the cutter arm 12 is held in a generally vertical position relative to the base 10, such as shown in FIG. 3, whilst a splint is positioned on the cradle 13 in the appropriate position for cutting a desired length of the splint. The arm 12 is then moved downwardly until the faces 15*a*, 15*a* of the tip of each finger 15, 15 engage the splint to secure it against movement, as shown in FIG. 1. Further movement of the cutter arm 12 towards the base causes the cutting edge 14*a* to move through the splint and sever it as the holder is moved to the position shown in FIG. 4. The fingers 15, 15 are sufficiently flexible to accommodate this further movement of the cutter arm whilst retaining the splint in position.

I claim:

1. A cutter for cutting elongate articles and comprising:

a base, means defining a shaped recess in the base for holding the elongate article against movement transverse to the length thereof, means defining a slot in the base, said slot intersecting the means defining the shaped recess to divide said means defining a shaped recess into two parts, an arm overlying the base, a hinge connecting the arm to the base to allow pivotal movement of the arm towards or away from the base, a blade held in the arm in register with the means defining the slot in the base, and resilient means mounted on the arm on opposite sides of the blade for engaging the elongate article in the means defining the recess, whereby, on pivotal movement of the arm towards the base, firstly the resilient means engage the elongate article to hold the elongate article in the means defining a recess, the blade then cutting the held article along the line of the means defining a slot, pivotal movement of the arm away from the base leaving the severed parts of the elongate article in the means defining a recess.

2. A cutter for cutting elongate articles and comprising a blade and a one piece plastics moulding, the one piece plastics moulding forming:

a base, means defining a shaped recess in the base for holding the elongate article during cutting against movement transverse the length thereof, means defining a slot in the base which divides the means defining the recess into two parts, an arm overlying the base, means for holding the blade on the arm in register with the slot, two resilient fingers, one on each side of the holder, each finger being cantilevered from the arm and having a free end thereof carrying an elongate article engaging means, and a hinge connection formed in one piece with and between the arm and the base to allow pivotal movement of the arm towards and away from the base whereby an elongate article placed in the means defining a recess is, on pivotal movement of the arm towards the base, firstly engaged by the article engaging means of the resilient fingers to hold the article in the means defining a recess and is then cut by the blade as the blade enters the means defining a slot, the resilient fingers bending during cutting to retain the severed parts of the elongate article in the means defining the recess.

3. A cutter according to claim 1, comprising means for at least partially shrouding the cutting edge of the cutting blade prior to engagement of the blade with the material which is to be cut.

* * * * *